United States Patent [19]

Chen

[11] Patent Number: 4,878,496

[45] Date of Patent: Nov. 7, 1989

[54] SELF-RETRACTABLE RUBBER NIPPLE

[76] Inventor: Bo-Zhou Chen, No. 130-18, Shih Lin Ts'un, Liu Ying Hsiang, Tainan Hsien, Taiwan

[21] Appl. No.: 32,463

[22] Filed: Mar. 31, 1987

[51] Int. Cl.[4] ..... A61J 17/00

[52] U.S. Cl. ..... 128/360

[58] Field of Search ..... 128/359, 360; 215/11.1, 215/11.5

[56] References Cited

U.S. PATENT DOCUMENTS 3,129,709 4/1964 Rountree ..... 128/360

*Primary Examiner*—Tony M. Argenbright

*Attorney, Agent, or Firm*—Browdy and Neimark

[57] ABSTRACT

The present disclosure is concerned with a self-retractable rubber nipple or pacifier which is intended to prevent an infant from getting into the habit of sticking to the same even in sleep by slowly retreating it from the mouth thereof without the baby's notice; which is characterized in that a hollow, collapsible pleated bellows-like element is planted on one side of the stop plate of a conventional rubber nipple with the pleated bellows-like element relatively moveable with respect to the elongated nipple member, and an air volume control unit is provided on the stop plate so that air can regulatively flow in the bellows-like element, expanding it to such an extent that the nipple can disengage from the mouth of an infant slowly without his or her notice.

3 Claims, 3 Drawing Sheets

FIG. 5A'
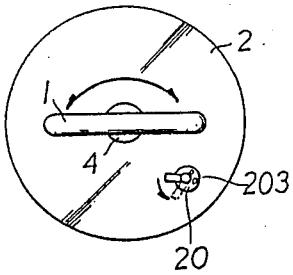
FIG. 5B'
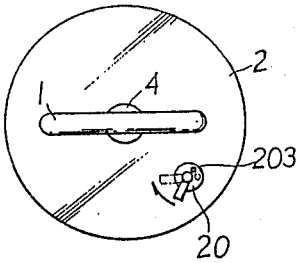
FIG. 5C'
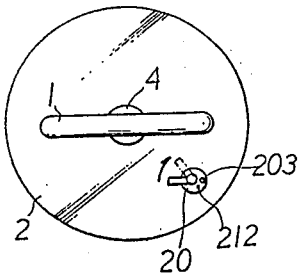
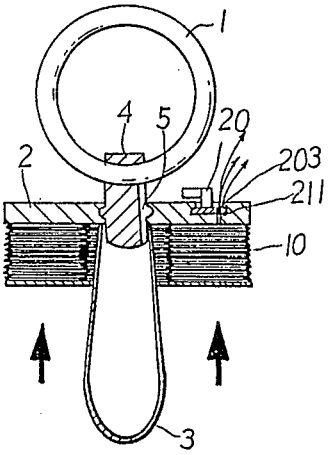
FIG. 5A
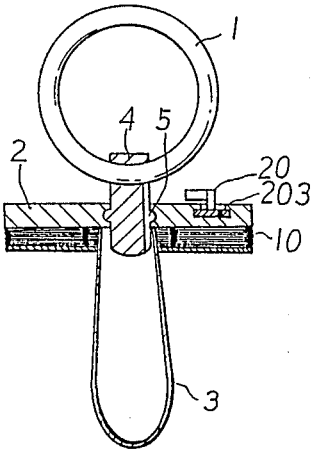
FIG. 5B
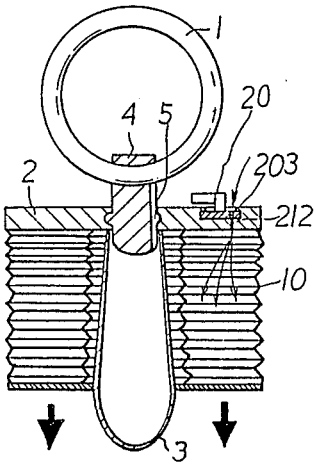
FIG. 5C
5A-C
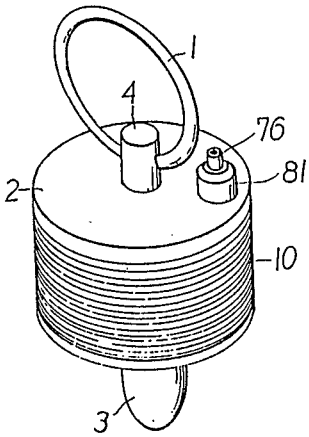
FIG. 6

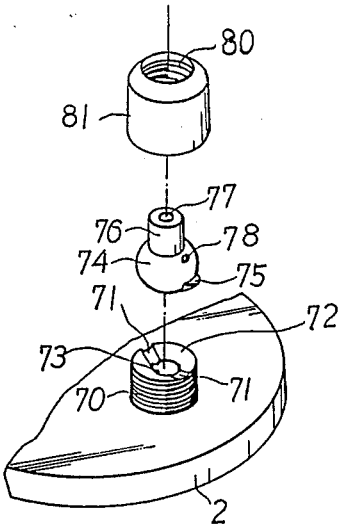
FIG.7
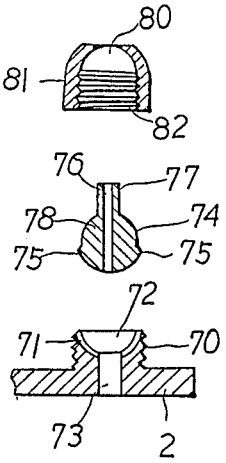
FIG.8
FIG. 9A'
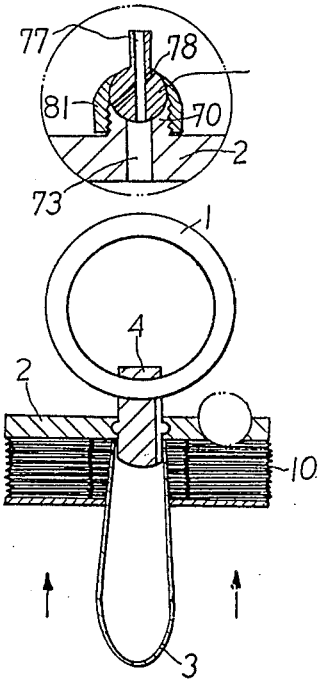
FIG.9A
FIG. 9B'
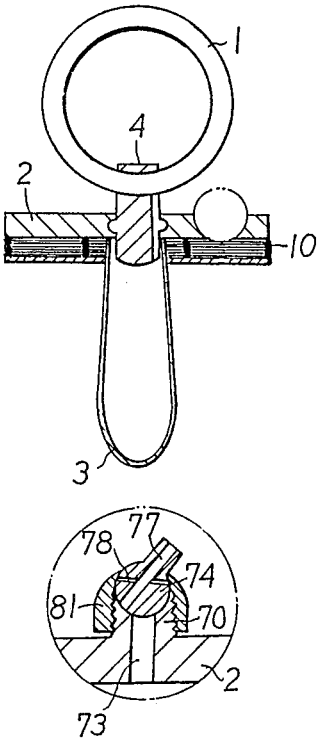
FIG.9B
FIG. 9C'
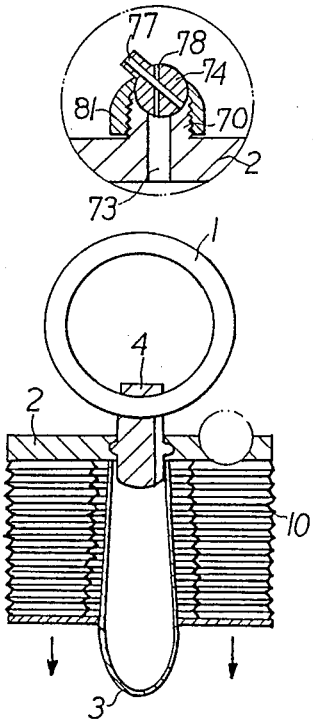
FIG.9C

SELF-RETRACTABLE RUBBER NIPPLE

SUMMARY OF THE INVENTION

The present invention is related to a self-retractable rubber nipple, and more particularly to the type which is furnished with a hollow collapsible bellows-like element in a cylinder form with a plurality of pleats defined on the surface thereof, and the bellows-like element is mounted on a stop plate of the present rubber nipple on the same side of an elongated nipple member with an air volume control unit disposed on said stop plate and working in combination with the bellows-like element so that air can flow therein, expanding the same to such an extent that the elongated nipple member can be slowly disengaged from the mouth of a sleeping infant so to prevent the baby from getting into a habit of sticking to the rubber nipple even in sleep.

The use of a rubber nipple or a pacifier has been of great help to calm down a crying infant and it has been widely used all over the world by parents as an effective means of pacifying babies to sleep; however, it is commonly seen that babies easily become habitually attached to such rubber nipple day and night, and parents are in every possible effort to make them kick the habit in fear that babies sticking to a rubber nipple will habitually keep their mouths in a pouting manner.

Viewing the problems and drawbacks a conventional rubber nipple can have, the present inventor has devoted himself to making improvement thereon so that a baby will not form a habit of sticking to a rubber nipple day and night, even in sleep.

The primary object of the present invention is to provide a self-retractable rubber nipple which is characteristically furnished with a pleated bellows-like element on the stop plate thereof, the hollow collapsible bellows-like element is mounted on the same side of an elongated nipple member and expandable against said stop plate when air flows therein through an air volume control unit operated by a ball valve or other kinds of control means so that the rubber nipple can slowly and automatically retreat from the mouth of a sleeping baby without his or her notice.

One further object of the present invention is to provide a self-retractable rubber nipple which is provided with an air volume control unit having three states of operation: fully closed state, fully opened state, partially opened state. When the air within said bellows-like element is entirely driven thereout via a fully opened air volume control unit and then the same is fully closed so to prevent the bellows-like member from expanding again and make the compressed bellows-like element attach to the stop plate in a squeezed manner, the present invention can can be used as a conventional rubber nipple. When the air volume control unit is put in a partially opened state, air can flush into said bellows-like element in a definite time, depending on the open state of said control unit, so to automatically retreat the present rubber nipple from the mouth of a sleeping baby accordingly.

One still further object of the present invention is to provide a simple structured but effectively operated rubber nipple which can prevent a baby from getting into a habit of sticking to a rubber nipple day and night.

A number of drawings are provided along with the following detailed description so to make the structure, operational modes and characteristics of the present invention presented in a clear way, in which:

BRIEF DESCRIPTION OF THE DRAWINGS

FIGS. 5A and 5A' are is a diagram showing the bellows-like element of the present rubber nipple being in a process of compression;

FIGS. 5B and 5B' are a diagram showing said bellows-like element being totally squeezed into a compact form;

FIGS. 5C and 5C' are a diagram showing said bellows-like element being fully expanded to cover most of the elongated nipple member disposed in front of a stop plate;

FIG. 6 is a perspective view showing the present rubber nipple equipped with another type of air volume control unit with a ball-valve;

FIG. 7 is an enlarged exploded view showing the detailed structure of a ball-valve type air volume control unit;

FIG. 8 is a cross sectional view of FIG. 7;

FIGS. 9A and 9A' are a diagram showing said bellows-like element being compressed for driving out the air therein FIGS. 9B and 9B; are a diagram showing said bellows-like element having been compressed into a compact form;

FIGS. 9C and 9C are a diagram showing said bellows-like element having been fully expanded by air.

DETAILED DESCRIPTION

Figure 1A:
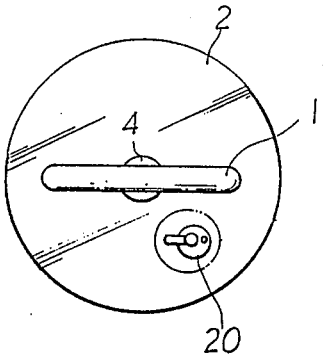
FIGS. 1A and 1B are is a top view of the present invention with an enlarged air volume control unit.
Figure 1B:
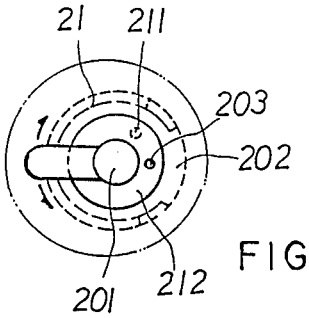
Figure 2A:
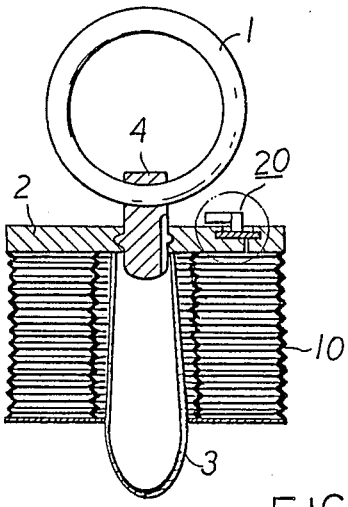
FIGS. 2A and 2B are a cross sectional view of the present self-retractable rubber nipple.
Figure 2B:
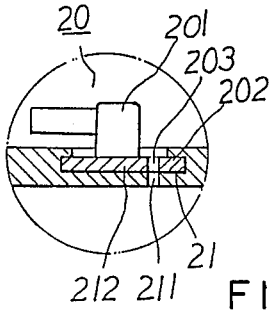

Refer to FIG. 1 and FIG. 2 in addition to conventional rubber nipple structural components, including a stop plate 2, a centrally located elongated nipple member 3, a plug 4 having an air-through cut 5 disposed on one side thereof and a pull ring 1 mounted at the top end thereof, the air-through cut 5 being set for preventing said nipple member 3 from being distorted as a result of the suction of a baby, the present self-retractable rubber nipple is additionally furnished with a collapsible bellows-like element 10 constructed to have a plurality of orderly-arranged pleats on the surface thereof, and an elongated nipple member 3 is disposed within the central portion of said hollow bellows-like element 10 which is movable with respect to said nipple member 3 when said bellows-like element 10 is being compressed or expanded.

Figure 3:
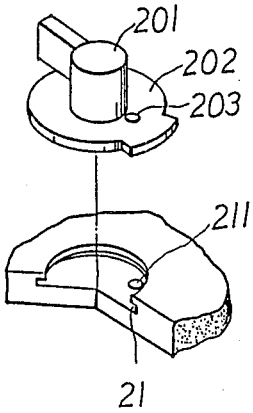
FIG. 3 is a perspective view of the air volume control unit of the present invention, shown in an exploded manner.

On said stop plate 2, there is positioned an air volume control unit 20, as shown in the enlarged diagrams in FIG. 1, FIG. 2 and FIG. 3, which consists of a turnable control disk 202 having an operation knob 201 mounted on the top thereof, and an air-through opening 203 defined thereon; a mounting seat 21, for the disposition of said control disk 202, is disposed on said stop plate 2 with a hole 211 defined at the bottom thereof which has a larger diameter than that of said air-through opening 203, and a relatively minute opening 212 is positioned next to said hole 211. By operating on said operation knob 201, said control disk 202 can be clockwise or counter-clockwise rotated so to alternatively make said air-through opening 203 in registration with either said hole 211 or said minute opening 212, or none of them, in this manner, the speed of air influx can be selectively controlled or air can be totally stopped from flowing therein.

Figure 4:
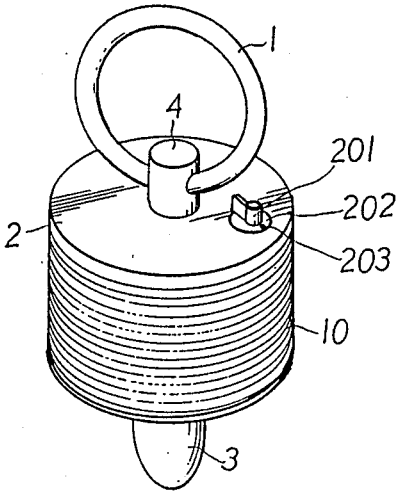
FIG. 4 is a perspective assembly view of the present rubber nipple.

Refer to FIG. 4 and FIG. 5A, when the air volume control unit 20 is put in an open state with said air-through opening 203 in registration with said hole 211 defined on the stop plate, the squeezing compression on said bellows-like element 10 results in the driving out of the air therein, causing the same squeezed into a small size as shown in FIG. 5B; at this time, said air control volume unit 20 is moved to a closed state to stop any air to flow in said bellows-like element to make it expand again so that the present rubber nipple can be used as a general nipple.

As shown in FIG. 5C, to let air slowly flow in said bellows-like element to cause it to expand in said bellows-like element to cause it to expand in a gradual manner, said air volume control unit 20 is moved in such a way that said air-through opening 203 can be in registration with said minute opening 212. The air flowing in said bellows-like element 10 accordingly makes it slowly expand so to disengage the present rubber nipple from the mouth of a sleeping baby without his or her notice.

Furthermore, another kind of a ball-valve is also able to be adopted in the air volume control unit, in place of said control disk 20, to effect the same control purpose. As shown in FIGS. 6, 7 and 8, a mounting means 70, projecting from the surface of said stop plate with its external surface peripherally threaded, is provided with an end to end bore 73 at the center thereof, running through the thickness of said stop plate 2, and a half-sphere concavity 72 is defined at the top thereof for the disposition of a ball-valve 74, a pair of symmetrically-located grooves 71 are planted on the surface of said half-sphere cavity 72; a pipe end 76 is extended from the top of said ball valve 74 for either being used as an operation stick or an air conducting pipe which has a tubular opening 77 going through the center of said ball-valve 74; a minute tube 78 is positioned in oblique relation with respect to said tubular opening 77, and a flanged portion 75 is defined at the bottom of said ball valve 74; a fixing cap 81 with its inner surface threaded and its top opening 80 having a slightly reduced diameter, is provided to movably fix said ball-valve in position therebetween when said fixing cap 81 is secured to said mounting means 70 by means of those defined threads.

In installation, said ball valve 74 is mounted on said mounting means 70 with its bottom located in said half-sphere cavity 72 and said flanged portion 75 in registration within said symmetrically-located grooves 71 for confining the same to moving in pre-determined manner, and said ball-valve 74 is movably fixed in place, by removably coupling said fixing cap 81 to said mounting means 70, with the pipe end 76 sticking out of said top opening 80 for ready operation thereof.

As shown in FIG. 9A, when said ball-valve 74 is placed in a vertical position with the pipe end 76 vertically lcoated in the right center of said mounting means 70, the tubular opening 77 becomes communicating to said open-ended bore 73 on said stop plate 2 so that the air in said bellows-like element 10 can be driven out thereof via said bore 73 and said tubular opening 77; when used as a conventional rubber nipple, as shown in FIG. 9B, with said bellows-like element 10 being in a compressed state, said ball valve 74 is moved with its pipe end 76 pointing to the right so to close the bore 73 for keeping said bellows-like element 10 from expanding by air; when said ball valve 74 is moved with its pipe end 76 shifted to the left, said minute tube 78 becomes in registration with said bore 73 and air can flow therethrough to make said bellows-like element rather slowly expand so that the rubber nipple of the present invention can disengage from the mouth of a sleeping baby without its notice.

I claim:

1. A self-retractable rubber nipple particularly provided with a collapsible bellows-like element which is made in a cylindrical and hollow form with a plurality of pleats on the external surface thereof and mounted on the same side of a stop plate where a nipple member is placed; and an air volume control unit being provided on said stop plate by means of which air can be regulatively controlled so to determine the expanding speed of said bellows-like element, in such a manner said rubber nipple can be slowly automatically removed from a baby's mouth without its notice.

2. A self-retractable rubber nipple according to claim 1, wherein said air volume control unit consists of a turnable control disk, having an operation knob planted on the top surface thereof and an air-through hole defined thereon, which is rotatably located in a mounting seat provided on said stop plate, and at the bottom of said mounting seat, there being defined a hole as well as a minute opening which can be selectively in communicating registration with said air-through hole of said control disk so to effect three types of control operation on said air volume control unit which can create a fully opened state, a partially opened state and a fully closed state.

3. A self-retractable rubber nipple accorcling to claim 1, wherein said air volume control unit is made up of a ball valve, a fixing cap, and a mounting means which is located on the top of said stop plate and configured in a cylinder form with its external surface threaded and its top end defined in a half-sphere form with a pair of symmetric grooves on the surface of said half-sphere cavity, and an end to end bore disposed through the center of said mounting means; said ball valve having an extended pipe end projected from the top thereof with a tubular opening located through the center of said ball valve and said pipe end, and a minute tube being obliguely disposed with respect to said tubular opening in said ball valve, and a flanged portion being defined at the bottom of said ball valve which is in engagement with a pair of said symmetric grooves on the surface of said half-sphere cavity so that said ball valve can be regulatively moved by actuating said pipe end planted at the top of said ball valve, and said fixing cap being removably coupled to said mounting means with said ball valve housed therebetween so that the air volume control unit can effect three types of operation which are a fully opened state, a partially opened state, and a fully closed state.

* * * * *